US005809908A

United States Patent [19]

Catta et al.

[11] Patent Number: 5,809,908

[45] Date of Patent: Sep. 22, 1998

[54] LIFTING MEANS

[75] Inventors: David Catta; Doug Bueley, both of Calgary, Canada

[73] Assignee: Evans Consoles, Inc., Calgary, Canada

[21] Appl. No.: 726,000

[22] Filed: Oct. 4, 1996

Related U.S. Application Data

[63] Continuation-in-part of Ser. No. 237,679, May 5, 1994, abandoned.

[51] Int. Cl.[6] ..... A47B 9/00

[52] U.S. Cl. ..... 108/147

[58] Field of Search ..... 108/147, 144, 108/106, 144.11, 147.11, 147.19; 240/422, 188.4, 650, 70

[56] References Cited

U.S. PATENT DOCUMENTS

| | | | |
|---|---|---|---|
| 2,792,268 | 5/1957 | Stanley | 108/147 X |
| 3,105,246 | 10/1963 | Emrick | 108/147 X |
| 3,587,482 | 6/1971 | Wieland | 108/147 |
| 4,590,865 | 5/1986 | Rutsche et al. | 248/422 X |
| 4,619,208 | 10/1986 | Kurrasch | 108/106 X |
| 4,627,364 | 12/1986 | Klein et al. | 248/422 X |
| 4,635,565 | 1/1987 | Novak | 108/147 |
| 4,651,652 | 3/1987 | Wyckoff | 108/144 |
| 4,987,835 | 1/1991 | Schwartz et al. . | |
| 5,022,327 | 6/1991 | Solomon | 108/147 |
| 5,337,678 | 8/1994 | Grout | 108/147 |
| 5,400,721 | 3/1995 | Greene | 108/147 |

FOREIGN PATENT DOCUMENTS

| | | |
|---|---|---|
| 1258288 | 8/1989 | Canada . |
| 2002028 | 8/1992 | Canada . |

*Primary Examiner*—Jose V. Chen
*Attorney, Agent, or Firm*—Notaro & Michalos PC

[57] ABSTRACT

There is described an improved mechanism for adjusting the height of a work surface, comprising vertically movable shafts for supporting a work surface thereon for up and down movement, an actuator operable for selectively raising or lowering the shafts, cables interconnecting the shafts and the actuator, the cables being displaceable to raise and lower the shafts in response to operation of the actuator and a compression resistant sleeve surrounding each of the cables between the shafts and the actuator.

26 Claims, 5 Drawing Sheets

LIFTING MEANS

This application is a continuation-in-part, division, of application Ser. No. 08/237,679, filed May 5, 1994 now abandoned.

FIELD OF THE INVENTION

The present invention relates to work stations and more particularly to height adjustable work surfaces associated with such stations.

BACKGROUND OF THE INVENTION

In a modern office or workplace, it is common to provide work stations utilized by numerous personnel. Each station will include one or more work surfaces for ordinary paper work, or to accommodate a typewriter, control panels or computer keyboards and related accessories such as a mouse. It is desirable for these work surfaces to be vertically adjustable to adapt to the varying requirements of different users. Conventional work stations are not designed with this facility in mind.

Various mechanisms have been introduced into the workplace to attempt to overcome this deficiency. However, many are expensive and cumbersome to install and use, and many fail to provide uniform lift when the balance or load at the lift points supporting the work surface is uneven.

To overcome these problems, a number of different solutions have been proposed, most of which involve the use of cables, fixed position pulleys and centrally mounted drive units. For example, in Canadian Patent 1,258,288 dated Aug. 8, 1989, a work surface height adjustment mechanism includes left and right side cable lift mechanisms, means to mount each of the lift mechanisms to a supporting surface such as a wall, pulleys connected to the vertically adjustable supports to which the work surface is mounted, and a central drive mechanism connected to the underside of the work surface at the exact midpoint thereof.

In addition to requiring numerous parts and components, including at least six pulleys, a complicated cable takeup system and mounting means to secure the cable lift mechanisms to a supporting wall panel, all of which add substantially to manufacturing and installation costs, there is virtually no flexibility permitted with respect to the positioning of the drive unit which must be mounted at the center of the work surface's lower surface. This is not always the most desirable or even practical location for the drive unit and the system as a whole is therefore rigid and non-adaptive to varying situations and requirements.

As cost and flexibility are major factors to customer acceptance of height adjustment mechanisms, there is a need for a system providing the advantages of systems such as taught in the '288 patent, without the rigidity and relative complexity thereof.

SUMMARY OF THE INVENTION

It is an object of the invention to provide a work surface height adjustment mechanism that obviates and mitigates from the disadvantages of the prior art.

It is a further object of the present invention to provide a height adjustment mechanism of substantially simplified construction and wherein the drive unit need not be located centrally relative to the work surface.

It is yet another object of the present invention to provide a height adjustment mechanism wherein the drive unit may be operated manually or with a powered assist.

According to the present invention then, there is provided a mechanism for adjusting the height of a work surface, comprising vertically movable shaft means for supporting a work surface thereon for up and down movement, actuator means operable for selectively raising or lowering said shaft means, cable means interconnecting said shaft and actuator means, said cable means being displaceable to raise and lower said shaft means in response to operation of said actuator means, and compression resistant sleeve means surrounding said cable means between said shaft means and said actuator means.

According to another aspect of the present invention, there is also provided a work surface height adjustment mechanism, comprising at least two horizontally spaced apart parallel shafts supported for reciprocating movement along the longitudinal axes thereof, said shafts being adapted to support a work surface thereon, actuator means operable for generating a force causing said reciprocating movement of said shaft means to selectively raise or lower a work surface, flexible cable means operatively connecting said actuator means and each of said shafts for respectively transmitting said force generated by said actuator means to said shafts, and compression-resistant sleeve means jacketing said cable means substantially continuously between said actuator means and said shafts.

BRIEF DESCRIPTION OF THE DRAWINGS

Preferred embodiments of the present invention will now be described in greater detail and will be better understood when read in conjunction with the following drawings in which.

DESCRIPTION OF THE PREFERRED EMBODIMENTS

Figure 1:
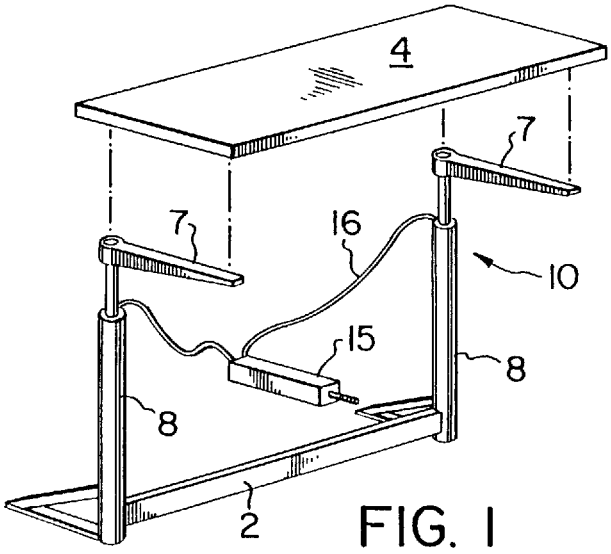
FIG. 1 is a perspective, partially exploded view of a height adjustable work surface in accordance with the present invention.

With reference to FIG. 1, there is shown generally a height adjusting mechanism 10 useful to raise and lower a work surface 4. The height adjustment mechanism generally comprises spaced apart, telescopic lift columns 8 which support work surface 4 by means of horizontally extending brackets 7 attached to the tops of each column, a drive unit or actuator 15 and jacketed cables 16 extending between the actuator and the lift columns, the cables being displaceable to raise and lower the columns as will be described in greater detail below.

Figure 2:
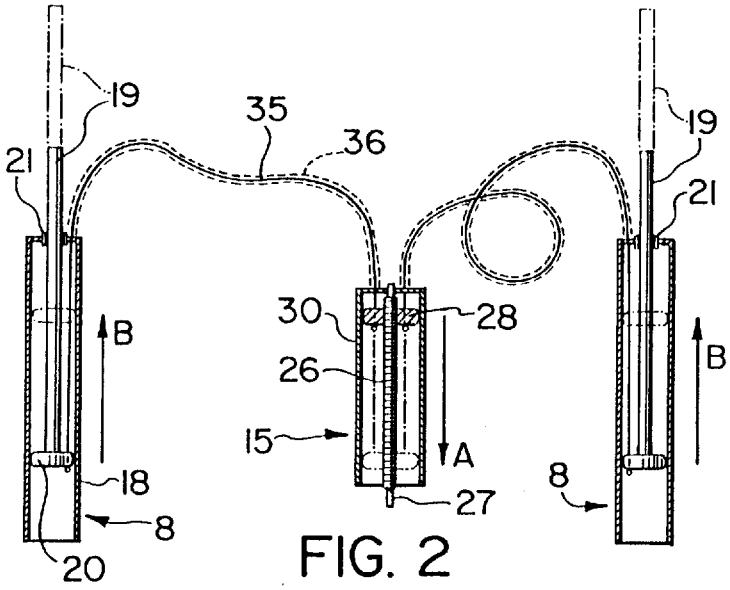
FIG. 2 is a schematical, front elevational, partially sectional view of the lift columns supporting the work surface and the drive unit therefor, the drive unit being shown in plan.

With reference to FIG. 2, each of lift columns 8 comprises an outer housing 18 adapted for connection to a supporting surface 2 (FIG. 1) and a telescopically associated shaft 19. Shaft 19 is slidably supported for vertically axial movement in and out of the housing by means of a bottom bushing 20 at the lower end of the shaft and a suitable bearing or low friction sleeve 21 at the upper end of housing 18.

Actuator 15 as shown in a simplified form in FIG. 2 comprises a power screw 26 journalled at its opposite ends into an actuator housing 30. One end of the power screw includes an extension 27 protruding through housing 30 for connection to a handle or hand crank (not shown) by means of which the screw can be turned in either a clockwise or a counter-clockwise direction.

Threadedly connected to power screw 26 is a cable carrying bushing or nut 28 which will move back and forth along the power screw within housing 30 depending upon whether the power screw is being turned clockwise or counterclockwise.

Connecting the actuator to each of the lift columns, or more particularly to each of shafts 19, is a flexible cable 35 sheathed within a flexible but compression resistant jacket or sleeve 36. Each sleeve 36 is preferably compression loaded between its respective points of connection at one end to the actuator and at the other end to housing 18 of each lift column or to some other convenient point just prior to cable 35's point of connection to shaft 19. Each cable 35 is connected at one of its ends to bushing 28 and at its other end to bottom bushing 20 at the lower end of shaft 19.

As will be obvious, any movement of bushing 28 back and forth along the power screw will be automatically translated into a corresponding up or down movement of shafts 19 as a result of the interconnection between the two by cables 35. More specifically, movement of bushing 28 in the direction of arrow A will cause an equal upward movement of shafts 19 in the direction of arrow B, with the amount of movement of each shaft 19 being exactly equal notwithstanding any unequal loading of work surface 4. Causing the movement of bushing 28 in the opposite direction will result in the lowering (by gravity) of shafts 19, again in substantially equal and coordinated increments.

In the system described above, the location of and point of mounting for the actuator is immaterial and in an extreme example, it can even be left to dangle. If preferred, the actuator can be mounted beneath the work surface, but where this is neither desired nor practical, it can be mounted anywhere else for easy access having regard to the lack of need for any fixed positioning, externally mounted and exposed pulleys or means to guide the cables 35 along a predetermined path. It will be appreciated as well that cables 16 need not be of equal length.

Figure 3:
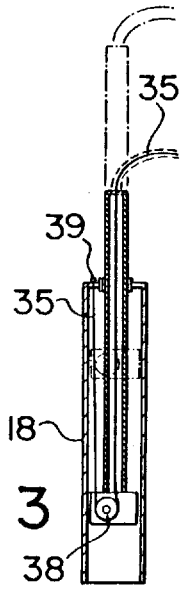
FIG. 3 is a front elevational, partially sectional view of an alternate lift column.

With reference to FIG. 3, there is shown an alternately configured lift column wherein cable 35 engages a small pulley 38 provided at the bottom of shaft 19 and is then fixedly connected to housing 18 such as at point 39.

Figure 4:
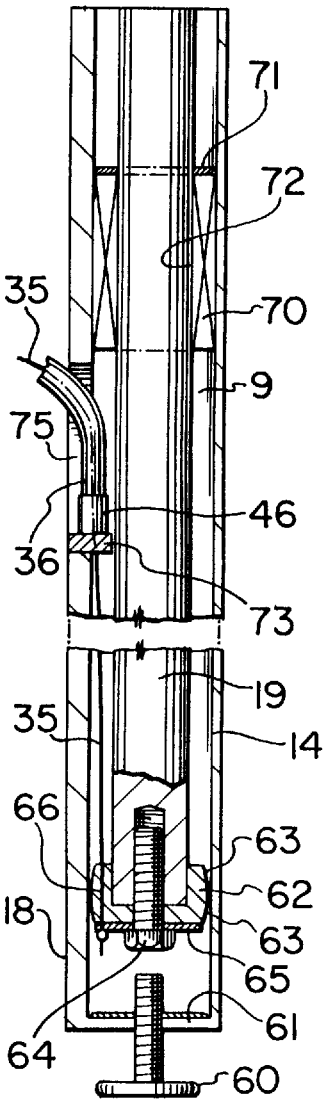
FIG. 4 is a side elevational, partially sectional more detailed view of a lift column.

With reference now to FIG. 4, an exemplary lift column assembly is shown in greater detail. Like numerals to those used in the previous figures have been used for like elements. The column shown in FIG. 4 is an elongated version adapted to engage the ground or floor by means of an adjustable foot or leveller 60 threadedly received into a bottom cap 61 press fit into the lower end of housing 18.

Shaft 19 is supported at its lower end by means of a bottom bushing 62 having chamfered peripheral edges 63 to facilitate its sliding movement along the inner walls of housing 18. A threaded bolt 64 and a washer 65 are used to securely connect the bushing and shaft together, with both the bushing and washer including aligned slots or apertures 66 to receive cable 35 therethrough.

The upper end of shaft 19 is slidably supported such as by means of a metallic sleeve 70 with an inner TEFLON (trade-mark) liner 72 and, optionally, a shaft seal 71.

Figure 5:
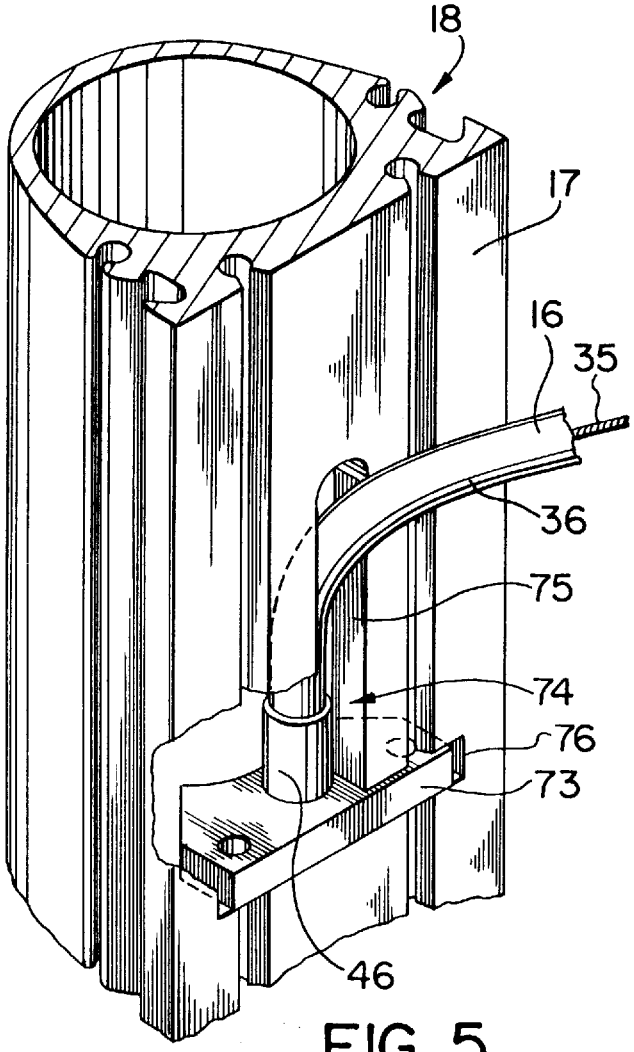
FIG. 5 is a rear perspective, partially sectional view of the upper part of the column shown in FIG. 4.

As seen most easily in FIG. 5, a cable stop plate 73 is fitted through the horizontal portion 76 of a T-shaped slot 74 formed in the rear surface 17 of housing 18. Plate 73 extends partially into the annulus 19 between the inner surface 14 of housing 18 and shaft 19 to engage bottom bushing 62 to limit the shaft's total predetermined upward travel. Plate 73 also provides a convenient point of attachment for a connector 46 that couples with the associated end of sleeve 36. The vertical portion 75 of T-shaped slot 74 provides clearance for the ingress of cable 16.

Figure 6:
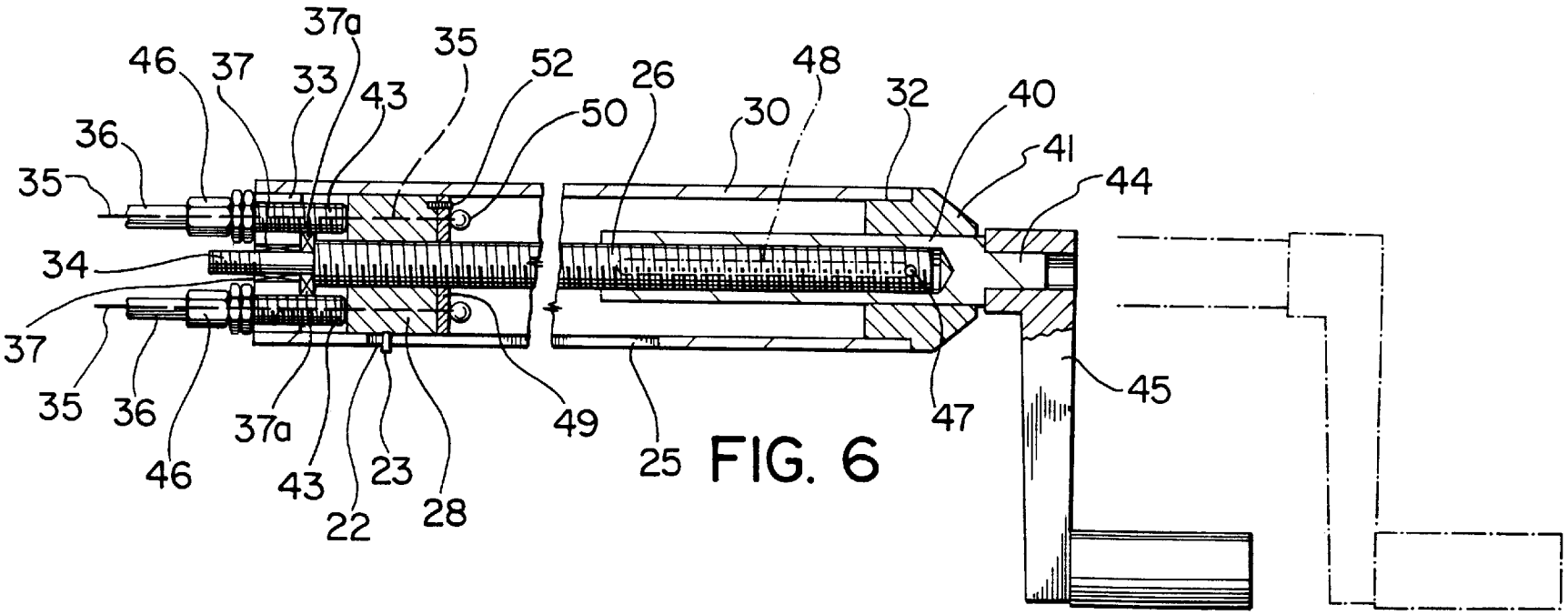
FIG. 6 is a partially sectional, more detailed plan view of a hand cranked drive unit.

With reference to FIG. 6, an exemplary hand cracked actuator assembly is shown in greater detail. Once again, like reference numerals to those used in the previous figures have been used for like elements.

As shown, the actuator comprises a cylindrical housing 30 and a power screw 26 aligned axially therein. The power screw is narrowed at its rearward end 34 and is journalled through a thrust plate 33 and bearings (e.g. brass bushings) 37 and 37*a*. Rearwardly protruding end 34 of the power screw is threaded for connection to a retaining nut (not shown for clarity). The forward end of the power screw is telescopically inserted into the rearwardly extending cylindrical end of a crank handle adaptor 40 which in turn is rotatably supported in axial alignment with housing 30 by means of a front end support block 41. The block may be made of any tough but low friction material such as nylon or DELRIN (trade-mark). Block 41 can be fitted into the leading end 32 of housing 30 and secured into place by means of, for example, a pair of screws (not shown).

Crank handle adaptor 40 includes a forwardly extending narrowed portion 44 for connection to a handle 45.

Adaptor 40 and the power screw are connected together for mutual rotation by means of a pin 47 or any other suitable connector. The adaptor additionally includes a longitudinally extending slot 48 to slidably engage pin 47, thus permitting the handle to be retracted into the position shown in dotted lines which is a convenient feature in certain installations.

A pair of threaded apertures 43 in thrust plate 33 are provided to engage cooperatively threaded cylindrical connectors 46 that couple with the respective ends of sleeves 36 and provide a passage for cables 35. As will be seen, cables 35 pass through connectors 46 for connection with carrier bushing 28 and a cable retaining washer 49. Preferably, both the bushing and the washer include at least one co-aligned threaded aperture 52 for a threaded fastener (not shown) connecting the two together. Bushing 28 includes chamfered peripheral edges 29 to facilitate its back-and-forth movement within the housing, and a small radially extending screw or pin 23 that tracks within a longitudinally extending slot 25 in the housing 30's outer wall to prevent the bushing from rotating relative to the housing. A small nylon sleeve 22 around the screw is provided to reduce friction and prevent binding of the pin within slot 25. Cables 35 may be retained in place by means of beads 50 connected to the cables at their respective ends.

Figure 7:
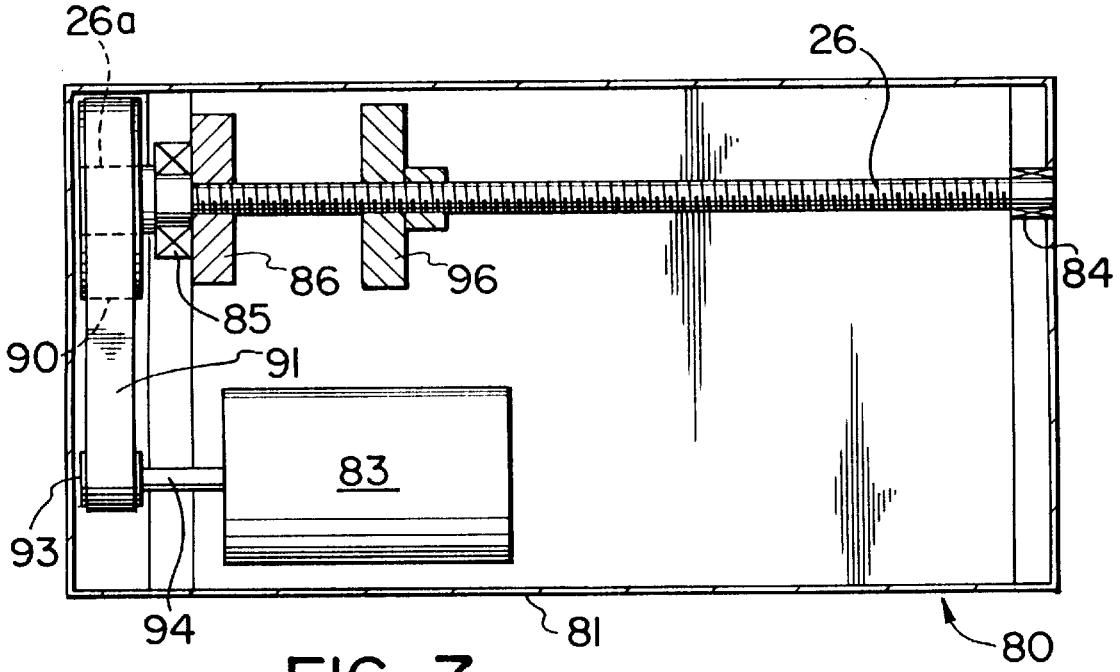
FIG. 7 is a partially sectional plan view of a power assisted actuator.

A power-assisted actuator 80 is shown with reference to FIG. 7. As before, like numerals are used to identify like elements.

Actuator 80 generally includes an outer housing 81 supporting the power screw 26 and a DC motor 83. The power screw is journalled at one of its ends into a sleeve bearing 84 and at its opposite end into a ball bearing 85 and bearing cap 86.

A rearward extension 26(*a*) of the power screw supports a cogged pulley 90 and a timing belt 91 connects this pulley to a similar but smaller cogged pulley 93 on the motor's impeller 94.

A carrier flange 96 is threadedly connected to the power screw for back and forth movement with the clockwise or counterclockwise rotation of the screw and of course the carrier flange is adapted for connection to cables 35 (not shown in this view).

Figure 8:
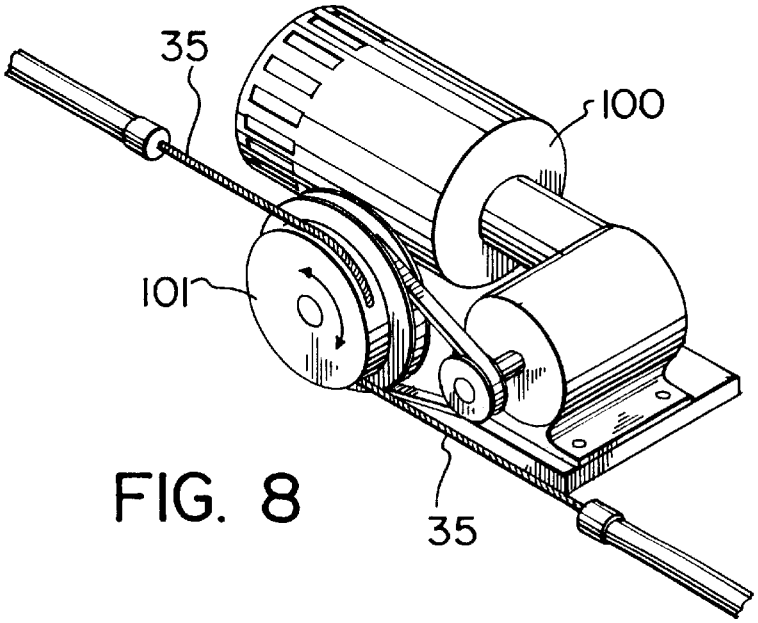
FIG. 8 is a perspective view of an alternate actuator including a gear motor assembly.

FIG. 8 shows another alternate power assisted actuator making use of a gear motor assembly 100 and a drum 101 which reciprocates back and forth to actuate cables 35 connected thereto. As will be appreciated, this particular embodiment eliminates the need for a power screw 26.

It has been found that the weight of work surface 4 is sufficient by itself to allow its lowering due to gravity as the actuator is turned in the appropriate direction. It is contemplated however that compression springs or other suitable means can be added to columns 8 to assist more positively in downward adjustments to the surface's position.

Figure 9:
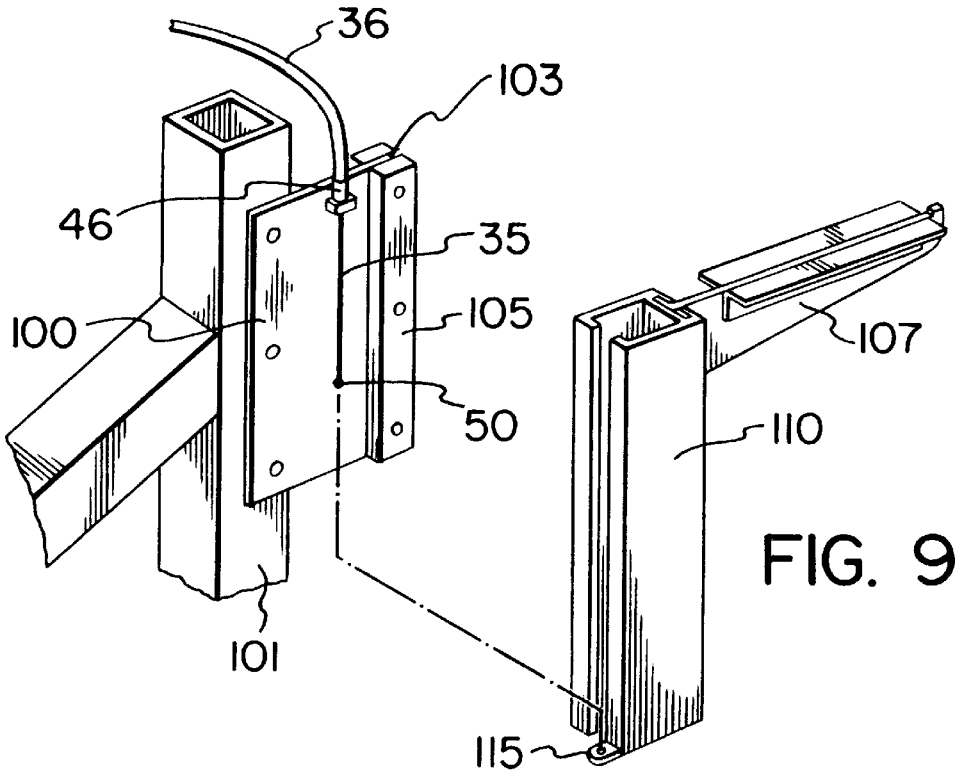
FIG. 9 is a perspective view of a modification to the support mechanism for the height adjustable work surface of FIG. 1.
Figure 10:
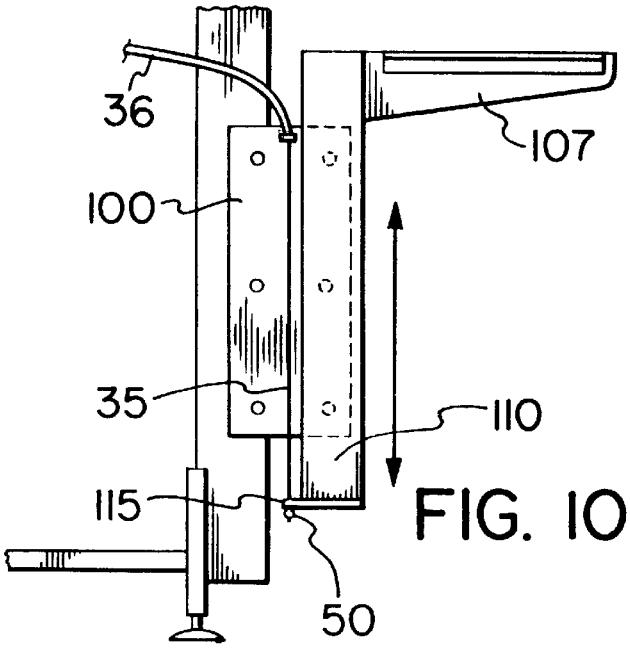
FIG. 10 is a side elevational view of the modified support mechanism of FIG. 9.

With reference to FIGS. 9 and 10, there is shown an alternative support mechanism which is potentially more economical to manufacture although the principles of operation remain much the same in relation to the use of telescopic lift column 8. Thus, rather than using a telescopic column, the support means comprise a bracket 100 that can be attached directly by any suitable means, such as screws, rivets, weldments or glue, to a structural member 101 or other part of the work station. The outer edge 103 of bracket 100 is provided with a glide 105 preferably made from a low friction material such as plastic, Nylon®, Teflon® or other materials, a number of which will be readily apparent to those skilled in the art.

Glide 105 is slidably received into a channel member 110 which will typically be either an extruded or forged plastic or metal component. As will be appreciated, channel 110 is adapted to move up and down relative to the guide in response to movement of cable 35 within jacket 36. As shown in the figures, a connector 46 is conveniently provided on bracket 100 to couple with the co-operating end of sleeve 36. Cable 35 connects to channel 110 in any suitable fashion such as by means of, for example, an eyelet 115 provided at the channel's lower edge which captures a bead 50 at the cable's end.

A support bracket 107 is provided at the upper end of channel 110 to support a work surface 4 (not shown). In most instances, a pair of spaced apart channels will be used to support a work surface although more can be used for a longer surface, and indeed, a single channel can be used in relation to a shorter surface, particularly one not expected to bear heavy loads or subjected to differential loading at opposite ends thereof.

Figure 11:
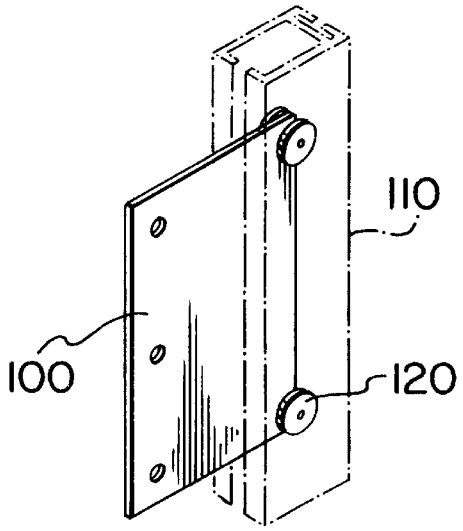
FIG. 11 is a perspecyive view of a further modification to part of the support mechanism of FIG. 9.

With reference to FIG. 11, a further modification is shown in which glides 105 are replaced with rollers 120. Other possibilities will occur to those skilled in the art.

It will be obvious to those skilled in the art that the scope of the present invention is not restricted to the embodiments disclosed above, but may instead be varied within the scope of the following claims without departing from the spirit and scope of the invention.

We claim:

1. A mechanism for adjusting the height of a work surface, comprising:

support means for supporting a work surface thereon, said support means comprising a fixed member adapted to remain stationary relative to a ground surface, and a movable member adapted for up and down movement;

actuator means operable for selectively moving said movable member of said support means relative to said fixed member of said support means, said actuator means comprising an active member adapted for movement, and drive means for selectively moving said active members;

cable means connecting said active member of said actuator means and said movable member of said support means; and flexible compression resistant sleeve means surrounding said cable means and having a first end adapted for connection to a first predetermined point fixed relative to said actuator means and a second end adapted for connection to a second predetermined point fixed relative to said support means;

whereby activation of said drive means of said actuator means causes linear movement of said cable means in said sleeve means to cause selective vertical movement of said work surface relative to a said ground surface.

2. The mechanism of claim 1 wherein said first end of said compression resistant sleeve means is connected to said actuator means and said second end of said sleeve means is connected to said fixed member of said support means.

3. The mechanism of claim 2 wherein said compression resistant sleeve means are connected under compression between said actuator means and said fixed member of said support means.

4. The mechanism of claim 1 wherein said movable member of said support means is an elongated member supported by said fixed member for up and down movement of said elongated member in the direction of the longitudinal axis thereof.

5. The mechanism of claim 4 wherein said elongated member is a shaft and said fixed member is a column for slidably supporting said shaft therein for said up and down movement thereof.

6. The mechanism of claim 4 wherein said movable member is a shaft and said fixed member is a guide adapted to slidably engage said shaft.

7. The mechanism of claim 6 wherein said shaft comprises a hollowed member adapted to receive therein said guide for guiding said up and down movement of said hollowed member.

8. The mechanism of claim 7 wherein said guide is comprised of a low friction material to facilitate said movement of said hollowed member relative thereto.

9. The mechanism of claim 7 wherein said guide comprises roller means.

10. The mechanism of claim 1 wherein said active member of said actuator means comprises an elongated threaded screw supported for clockwise and counter-clockwise rotation about the longitudinal axis thereof, and nut means operatively associated with said screw to move longitudinally back and forth relative thereto responsive to clockwise or counter-clockwise rotation of said screw.

11. The mechanism of claim 10 wherein said cable means are operatively connected at one end thereof to said nut means for movement therewith to cause said selective adjustment to the benefit of said work surface, the lowering of said work surface being assisted by gravity.

12. The mechanism of claim 11 comprising an actuator housing for rotatably supporting said threaded screw.

13. The mechanism of claim 12 wherein said first end of said compression resistant sleeve means is connected to said actuator housing.

14. The mechanism of claim 11 wherein said drive means include a handle operatively connected to said threaded screw for manual rotation thereof.

15. The mechanism of claim 11 wherein said drive means comprise motor means operatively connected to said threaded screw for driven rotation thereof.

16. The mechanism of claim 10 wherein said active member comprises a drum selectively rotatable in a clockwise or counterclockwise direction for displacement of said cable means.

17. A mechanism for adjusting the height of a work surface, comprising:

support means for supporting a work surface thereon, said support means comprising a fixed member adapted to remain stationary relative to a ground surface, and a movable member adapted for up and down movement;

actuator means operable for selectively moving said movable member of said support means relative to said fixed member of said support means, said actuator means comprising a base member, an active member adapted for movement relative to said base member, and drive means for selectively moving said active member relative to said base member;

cable means having a first end operatively connected to said active member of said actuator means, and a second end operatively connected to said movable member of said support means; and flexible compression resistant sleeve means surrounding said cable means and having a first end adapted for connection to a first predetermined point fixed relative to said base member of said actuator means and a second end adapted for connection to a second predetermined point fixed relative to said fixed member of said support means, whereby activation of said actuator means causes linear movement of said cable means in said sleeve means to cause selective vertical movement of said work surface relative to said ground surface between predetermined limits.

18. A work surface height adjustment mechanism, comprising:

at least two horizontally spaced apart support means for supporting a work surface thereon, each said support means comprising a fixed member adapted to remain stationary relative to aground surface, an a moveable member adapted for up and down movement;

actuator means operable for selectively and respectively moving said movable member of each said support means relative to said fixed member of each said support means, said actuator means comprising an active member adapted for movement and drive means for selectively moving said active member;

cable means respectively connecting said active member of said actuator means and said movable members of said support means; and flexible compression resistent sleeve means surrounding said cable means, each sleeve having a first end adapted for connection to a first predetermined point fixed relative to said actuator means and a second end adapted for connection to a second predetermined point fixed relative to a respective said support means, whereby activation of said drive means of said actuator means causes linear movement of said cable means in said sleeve means to cause selective vertical movement of said work surface relative to said ground surface.

19. The height adjustment mechanism of claim 18 wherein said active member of said actuator means comprises an elongated threaded screw supported for clockwise and counter-clockwise rotation about the longitudinal axis thereof, and nut means operatively associated with said screw to move longitudinally back and forth relative thereto responsive to clockwise or counterclockwise rotation of said screw.

20. The height adjustment mechanism of claim 19 comprising an actuator housing for rotatably supporting said threaded screw.

21. The height adjustment mechanism of claim 20 wherein said first end of each said compression resistant sleeve means is connected to said actuator housing.

22. The height adjustment mechanism of claim 21 wherein said cable means are operatively connected at one end thereof to said nut means for movement therewith, the lowering of said work surface being assisted by gravity.

23. The height adjustment mechanism of claim 22 wherein said drive means include a handle operatively connected to said threaded screw for manual rotation thereof.

24. The height adjustment mechanism of claim 22 wherein said drive means include motor means operatively connected to said threaded screw for driven rotation thereof.

25. The height adjustment mechanism of claim 19 wherein said active member comprises a drum selectively rotatable in a clockwise or counter-clockwise direction for displacement of said cable means.

26. The height adjustment mechanism of claim 18 wherein said first ends of said sleeve means are connected to said actuator means and said second ends of said sleeve means are connected to respective ones of said fixed members of said support means.

* * * * *